US005183205A

United States Patent [19]

Hoffman

[11] Patent Number: 5,183,205

[45] Date of Patent: Feb. 2, 1993

[54] CENTRIFUGAL NOZZLE

[76] Inventor: Paul Hoffman, 4125 Ricklyn Dr., Chambersburg, Pa. 17201

[21] Appl. No.: 791,558

[22] Filed: Nov. 14, 1991

[51] Int. Cl.[5] ..... B05B 3/10

[52] U.S. Cl. ..... 239/222.13; 239/224

[58] Field of Search ..... 239/214, 681, 688, 461, 239/222.11, 222.13, 224

[56] References Cited

U.S. PATENT DOCUMENTS

| | | | |
|---|---|---|---|
| 420,879 | 2/1890 | Kisinger et al. | 239/214 |
| 421,729 | 2/1890 | Kisinger | 239/224 |
| 428,113 | 5/1890 | Layman | 239/224 |
| 447,778 | 3/1891 | Kisinger | 239/224 |
| 2,003,575 | 6/1935 | Bowen | 239/222.11 |
| 2,010,902 | 8/1935 | Stephansen | 239/214 |
| 2,087,627 | 7/1937 | Nyrop | 239/222.11 |
| 2,936,563 | 5/1960 | Blume . | |
| 3,625,430 | 12/1971 | Arnold et al. | 239/222.11 |
| 4,541,566 | 9/1985 | Kijima et al. . | |
| 5,082,186 | 1/1992 | Bruns | 239/688 |

FOREIGN PATENT DOCUMENTS

| | | | |
|---|---|---|---|
| 1072836 | 2/1984 | U.S.S.R. | 239/681 |
| 1074431 | 2/1984 | U.S.S.R. | 239/681 |
| 1261575 | 10/1986 | U.S.S.R. | 239/681 |
| 1514266 | 10/1989 | U.S.S.R. | 239/681 |

*Primary Examiner*—Andres Kashnikow
*Assistant Examiner*—Christopher G. Trainor
*Attorney, Agent, or Firm*—Eckert Seamans Cherin & Mellott

[57] ABSTRACT

A centrifugal sprayer has a rotatable shaft defining a rotation axis, and a vane attached to the shaft and oriented perpendicular to the rotation axis. The vane extends radially from a heel end at a radial distance from the rotation axis to a toe end at a radially further distance from the rotation axis. The vane has a hollow front face in a direction of rotation. The hollow front face can extend radially, in which case an injector outlet port is placed at a radial distance from the rotation axis, within a circumference defined by the heel end of the rotating vane, for emitting a substance stream in a non-radial direction. Alternatively the stream can be radial and the vane inclined. The vane intersects the substance stream at an angle, the point of intersection between the stream and the vane progressing from the heel end to the toe end and from a trailing end of a separated stream segment to the leading end. The separated segment is carried and accelerated along the front face of the vane, accumulating a concentrated substance payload which is ejected along an arc substantially in the plane of the injector outlet.

19 Claims, 5 Drawing Sheets

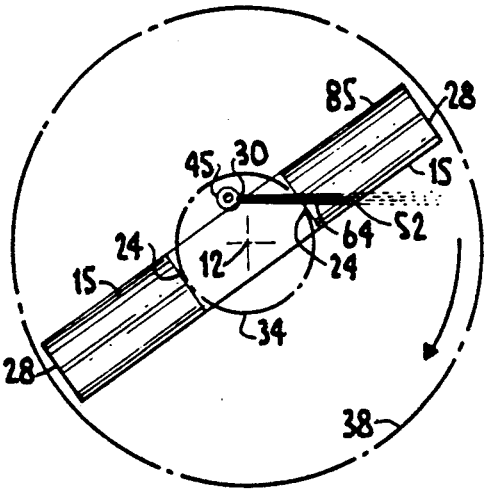
FIG. 4.
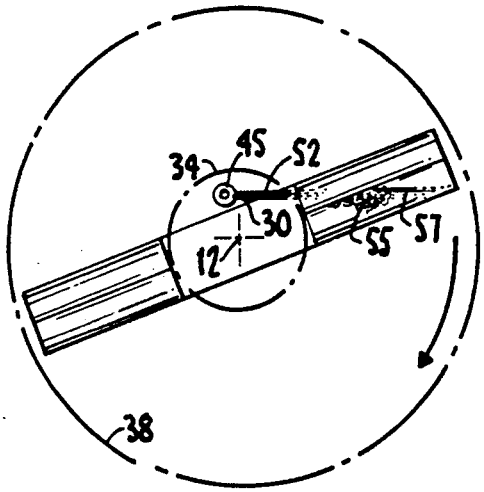
FIG. 5.
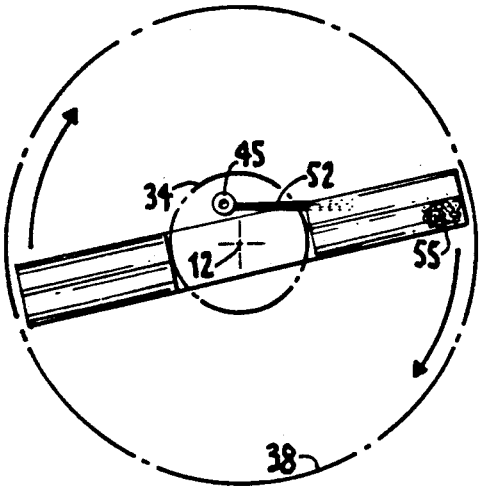
FIG. 6.
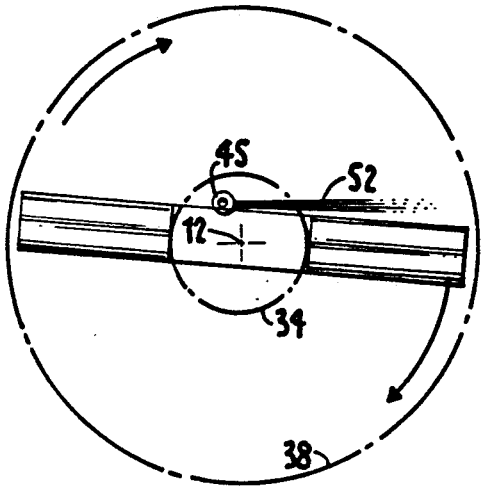
FIG. 7.
FIG. 8.
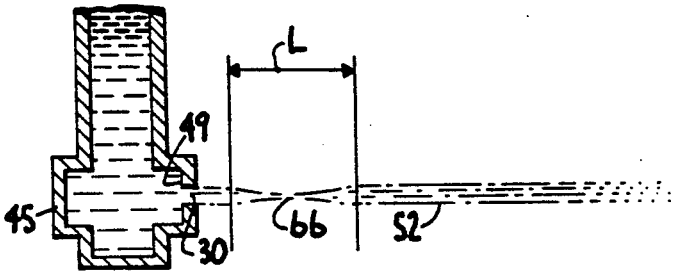

CENTRIFUGAL NOZZLE

BACKGROUND OF THE INVENTION

1. Field of the Invention

The invention relates to the field of apparatus for discharging a substance, and more particularly, to an apparatus having rotatable vanes, which is operable to impart centrifugal force to the substance, such that the substance is discharged at increased velocity and in a path of desired orientation and divergence.

2. Prior Art

Devices are known for imparting a centrifugal force to a fluid or granular substance or to a slurry of both, in order to discharge the substance at an increased velocity. Such devices typically include a rotatable impeller wheel having a number of radially oriented vanes. The fluid or granular substance is introduced at a central portion of the wheel and is collected by the vanes as the wheel rotates. Each portion of the substance follows a spiral path and is ejected from the impeller at the vane tips. The portion is emitted in the plane of the impeller vanes at a tangent to its spiral path. Relative to the impeller the substance has a tangential velocity component and a radial velocity component. The relationship of the radial and tangential components, and the timing of emission into the impeller and travel along the vanes, determine the particular angle relative to the impeller at which each portion of the substance is directed.

Centrifugal discharge devices are disclosed in U.S. Pat. Nos. 421,729 (Kisinger); 2,936,563 (Blume); and 4,541,566 (Kijima et al). These patents each disclose a device for developing a liquid spray around the entire circumference of a rotating apparatus. More specifically, these devices are intended to produce a spray around their entire circumference in order to dispense the liquid in all directions from the point of discharge into the impeller.

For certain applications, however, a liquid spray directed over a limited angle is desirable. U.S. Pat. No. 3,625,430 (Arnold et al) discloses a rotary liquid spray generator which is intended to produce a liquid spray over a limited angle. The spray generator has a plurality of blades arranged radially on a rotatable ring. A liquid supply pipe is centrally located within the rotatable ring and has an opening which directs a stream of the liquid radially outwardly, where it is encountered by the blades. The liquid spray is claimed to be generated over an angle approximately equal to the angle of the opening; however it is difficult or impossible in a device of this kind to obtain any precise control of the liquid spray pattern. According to Arnold the device is intended to produce a fine spray for wetting dust particles intersecting the spray, and the device is not suitable for producing a spray wherein substantial velocity is to be imparted to the liquid substance.

It is known to confine the discharge of a rotary impeller by enclosing the impeller in a housing which has an axial inlet to the impeller and an outlet nozzle directed tangentially along a peripheral edge. Such devices confine the output but do not permit adjustment of the spray pattern over different angles and in different directions (at least not without repositioning the housing and/or varying the character of the nozzle). Nor do such devices efficiently use the energy of the impeller to impart velocity to the spray. The radial velocity and the tangential velocity produced by the impeller at points other than at the ends of the blades approaching the outlet nozzle are wasted because the liquid is confined by the housing leading to the outlet nozzle.

A centrifugal spray device which develops a spray in a precise and controllable angular spray pattern without using a nozzle or similar confining structure would be advantageous in that it would more efficiently utilize the energy of the impeller and its motor or other drive means. Provided the impeller of such a device can be arranged to direct the sprayed substance along the desired outlet path only, the impeller can develop a more forceful spray than a comparable device wherein the spray is confined to a desired outlet path by fixed structures which interfere with the flow of the substance while guiding the substance to the outlet.

The invention provides a centrifugal spray apparatus which generates a spray in a precise angular pattern. The apparatus produces a spray similar to that produced by a centrifugal or tangential nozzle, without directing the sprayed substance against fixed interfering structures, thereby imparting a high velocity to the substance while reducing scattering. The invention allows for adjustment of the substance spray pattern over different angles and in different directions.

SUMMARY OF THE INVENTION

It is an object of the invention to provide an efficient centrifugal spray apparatus wherein the liquid or other substance being sprayed is directed substantially toward the desired outlet rather than against fixed guiding structures.

It is another object of the invention to provide a spray apparatus which utilizes centrifugal forces to increase the energy of a stream of substance to be sprayed, accelerating the substance in a spiral path to the desired outlet.

It is a further object of the invention to provide an apparatus which develops a spray over a limited angle substantially in a plane.

It is yet another object of the invention to provide a centrifugal spray apparatus which permits adjustment of the angle and direction of the spray.

It is still another object of the invention to provide a centrifugal spray apparatus having a rotating vane which intersects a segment of a substance stream, to accelerate a back end of the segment toward a front end of the segment.

These and other objects are accomplished by a centrifugal spray apparatus having a rotatable shaft defining a rotation axis. A vane is attached to the shaft, defining a surface which is elongated in a direction substantially perpendicular to the rotation axis. The vane subtends a predetermined axial distance and defines a heel end at a radial distance from the rotation axis, a toe end at a radially further distance from the rotation axis, and a hollow front face in a direction of rotation. The hollow front face has a radially elongated centerline which defines a segment of a plane perpendicular to the rotation axis as the vane rotates. The apparatus further includes an injector having an outlet disposed at a radial distance from the rotation axis, the radial distance as shown being within a circumference defined by the heel end of the vane as the vane rotates. A stream of the substance to be sprayed, which can be liquid, granular, a slurry or some other flowable material, is emitted from the outlet substantially in the plane defined by the centerline of the rotating vane, but not in a radial direction relative to the impeller vane. The stream is directed such that the vane intersects the stream at an angle, with the contact point between the stream and the vane progressing from the heel end of the vane to the toe end of the vane as the vane rotates. In order to achieve this relationship, the stream is directed somewhere in the 180° semicircular arc following the radius on which the injector is disposed, relative to the direction of rotation of the vane. With suitable adjustment of the stream velocity and direction, the position of the injector and the rotational velocity of the vane, the particular spray pattern achieved according to the invention can be varied.

The vane separates the fluid stream into stream segments, each of the stream segments being picked up and guided along the front face of the vane, moving along a spiral arc which is substantially in the plane, to a point of ejection tangential to the arc at the toe end of the vane.

The invention has the advantage of being adjustable to produce a spray having high density which is concentrated along a limited angle. The angle can be varied at a given stream velocity and rotational velocity, by changing the direction of the substance stream or by changing the radial distance between the rotation axis and the injector. The invention is useful, for example, to produce a high density, high impact spray for liquid wash processes, particularly because the action of the impeller can substantially increase the substance velocity as compared to the velocity of the stream emitted by the injector. The sprayed substance can be all liquid, all dry flowable material, or a slurry. Advantageously, the spray can include abrasive particles carried in a liquid, for surface finishing applications.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, which are exemplary. In the drawings.

FIG. 5 is a plan view of the centrifugal spray apparatus according to the invention, showing intersection of a middle portion of the vane with the substance stream.

FIG. 6 is a plan view of the centrifugal spray apparatus according to the invention, showing intersection of a toe end of the vane with the substance stream.

FIG. 7 is a plan view of the centrifugal spray apparatus according to the invention, showing a direction of substance discharge after the vane intersects the substance stream.

FIG. 8 is a cross-section view of an injector having a stepped opening for emitting a substance stream having a vena contracta.

DETAILED DESCRIPTION OF THE PREFERRED EMBODIMENTS

Figure 1:
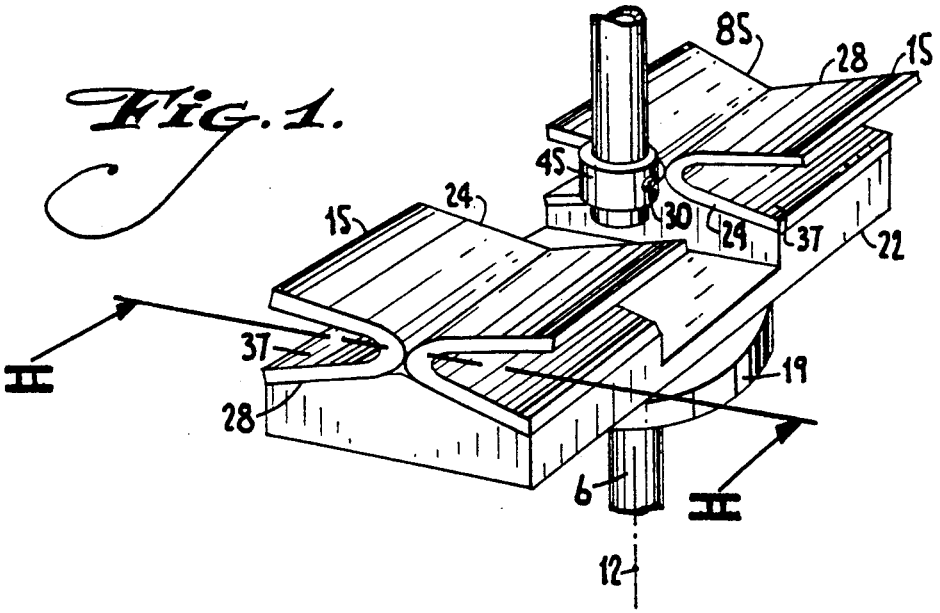
FIG. 1 is a perspective view of a centrifugal spray apparatus according to the invention.

A centrifugal spray apparatus according to the invention as shown in FIG. 1 includes a shaft 6 coupled to a driving means such as an electric motor (not shown) for rotating the shaft 6 on a rotation axis 12. A vane 15, elongated substantially in a radial direction, is attached perpendicular to the shaft 6 for rotation about the rotation axis 12. The vane 15 can be formed of a sheet material mounted relative to the shaft 6 on a spoke 22 as shown in FIG. 1, which is attached in turn to a mounting flange 19 on the shaft, such as by threaded fasteners. Vane 15 is thereby attached to shaft 6, and defines an impeller for accelerating and orienting the substance to be sprayed.

Figure 2:
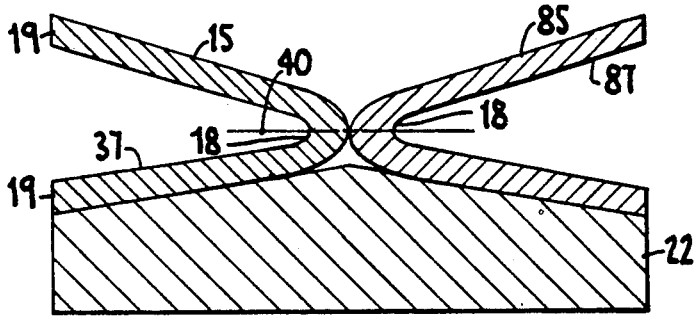
FIG. 2 is a cross-section view of a vane for the centrifugal spray apparatus according to the invention, taken along line 2—2 of FIG. 1.

In a preferred embodiment as shown in FIGS. 1 and 2, the centrifugal spray apparatus also includes a reverse vane 85 mounted back to back with the vane 15. In this embodiment, the reverse vane 85 is a mirror image of the vane 15, and is provided such that the centrifugal spray apparatus can operate in either a forward direction or a reverse direction. Additionally, opposite pairs of the vanes 15, 85 preferably are mounted on opposite ends of the spoke 22, symmetrically arranged on the shaft 6 such that the impeller is balanced.

The vane 15 defines a heel end 24, namely the end located at a relatively shorter radial distance from the rotation axis 12, and a toe end 28, the end located at a radially further distance from the rotation axis 12, as best seen in FIG. 4. The heel end 24 and the toe end 28 define an inner circumference 34 and an outer circumference 38, respectively, shown by dashed lines in FIGS. 4–7, as the vane rotates.

The vane 15 defines a hollow or trough-like form opening in a direction facing the direction of rotation. The front face or surface 37 of the vane preferably tapers in cross section to a bottom 18, as shown in FIG. 2. In this embodiment the internal contour is such as to concentrate the substance in the bottom 18 of the trough when the vane is rotated. It is also possible, although not preferred, to provide a U-shaped or channel-like vane which extends radially of the rotation axis at its bottom. For confining the substance to a tight pattern in a plane, the bottom 18 of the vane as shown in FIG. 2 tends to confine and emit the substance in a plane common to the plane defined by centerline 40 as the vane rotates. This vane 15 has a cross-section which defines a V-shape, the inside of the V providing the front face 37 of the vane, and a vertex of the V corresponding to the centerline 40. Alternatively, the vane may define some other, e.g., concave shape for holding the substance as the vane rotates around the axis.

Figure 12:
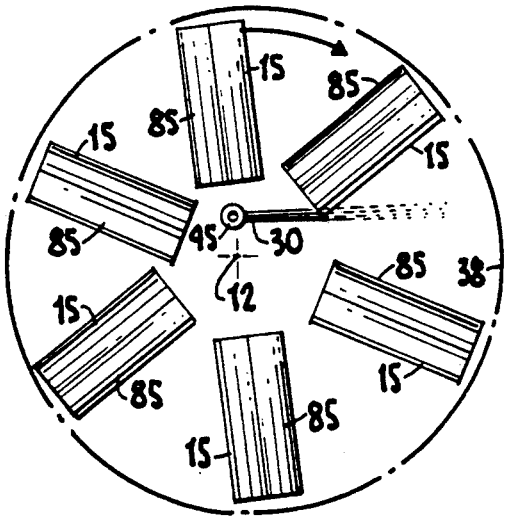
FIG. 12 is a plan view of the centrifugal spray apparatus having a plurality of vanes according to the invention.
Figure 13:
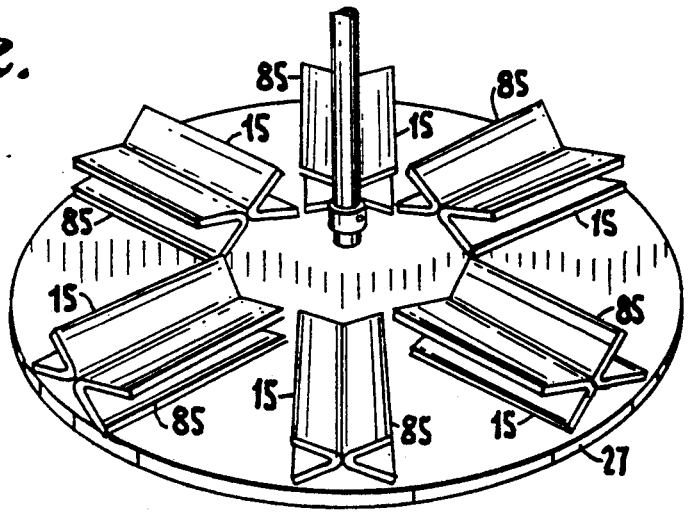
FIG. 13 is a perspective view of the centrifugal spray apparatus having a plurality of vanes according to the invention.

The spray apparatus may include a plurality of the vanes 15, each of the vanes being mounted on one of a plurality of the spokes 22, as in the embodiment FIG. 12. Furthermore, the plurality of the spokes 22 may include or be defined by a disk 27, as shown in FIG. 13. For the spray apparatus having the plurality of vanes 15, each of the vanes can have the same length, or the vanes can have different lengths. Similarly, each of the heel ends 24 of the vanes 15 may be disposed at the same radial distance from the rotation axis as every other of the heel ends, or the heel ends 24 may each be disposed at different radial distances from the rotation axis in order to provide more than one spray discharge as will be more fully discussed hereinafter. Notwithstanding these alternatives, it is advantageous that the impeller structure as a whole be substantially symmetrical around the rotation axis, to avoid vibration and wear problems associated with an unbalanced impeller.

An injector 45 directs the substance in a stream which intersects the path of the front face 37 of vane 15. Preferably the injector has an outlet orifice disposed within the inner circumference 34 defined by the innermost heel end 24 as the vane 15 rotates, which directs the stream outwardly in a plane common to the plane defined by centerline 40. The injector 45 is connected to a supply of liquid or other medium by any suitable tubing or piping system as is well known in the art. The liquid medium is delivered to the injector 45 at a pressure which is preferably produced by a suitable pump, but may be produced by gravity or by other available pressure, such as that available at the connection to the municipal or other water supply.

The outlet orifice or outlet port 30 of injector 45 is disposed at a radial distance from the rotation axis of the vane or vanes, for discharging a stream 52 as shown in FIGS. 4–7. The outlet port 30 is oriented to discharge the stream 52 in the plane defined by the centerline 40 of the rotating vane, or at least to discharge the stream so as to be substantially picked up on the front face 37 of vane 15. The outlet port 30 is further oriented such that the liquid stream is discharged in a non-radial direction. More particularly, the stream is directed such that the moving vane 15 intersects the stream 52 at an angle, with the contact point between the stream and the vane progressing from the heel end 24 of the vane 15 to the toe end 28 as the vane rotates. In order to achieve this relationship, and with reference to the impeller as viewed along the axis of rotation as shown in FIGS. 4–7, the stream is directed somewhere in the 180° semicircular arc following the radius (substantially vertical in FIGS. 4–7) on which the injector is disposed. With suitable adjustment of the stream velocity and direction, the position of the injector and the rotational velocity of the vane, the particular spray pattern achieved according to the invention can be varied. It is possible to provide means for adjusting these aspects for setting the spray output to desired characteristics.

Figure 9:
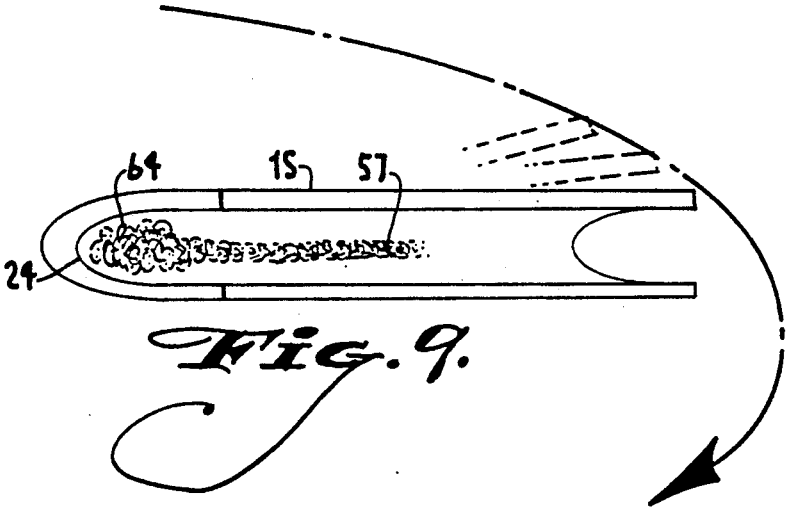
FIG. 9 is a perspective view of the vane intersecting the substance stream as shown in FIG. 4.

As the vane 15 rotates, the leading surface of the vane intersects the liquid stream 52 at an angle, with the point of contact between the vane and the stream progressing from the heel end 24 to the toe end 28, and from the trailing end of the stream to the leading end, as the vane continues to pass through the path of the stream. As shown in FIGS. 4 and 9, the heel end 24 first intersects the stream 52 as the vane 15 passes through the path of the stream, and thereby isolates a portion of the stream, the isolated portion defining a stream segment 57. The vane 15 is rotated at a velocity which is sufficient to accelerate the trailing end 64 of the stream segment 57 which has been contacted by the heel end 24, the substance thereby captured in the vane being moved in a spiral path as the vane rotates. Accordingly, the motor or other drive means must be selected to provide a suitable rotational speed for the vanes. Further, the drive means must have sufficient power capacity to maintain the desired rotational speed under the load incurred as the successive vanes intersect the stream.

Figure 3:
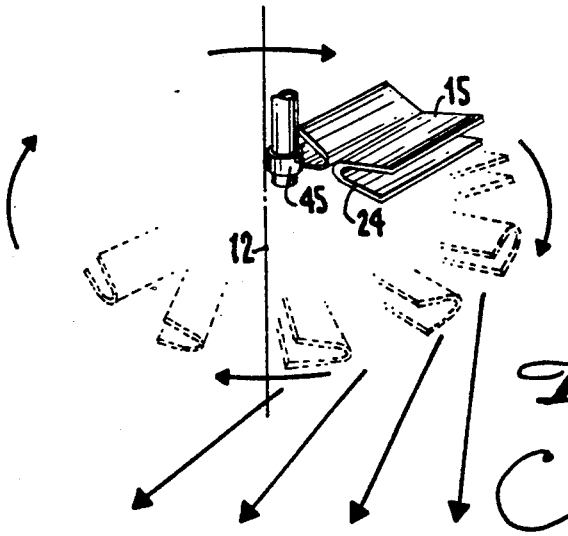
FIG. 3 is a perspective view of a centrifugal spray apparatus according to the invention, illustrating a representative discharge angle for the spray. according to the invention, showing intersection of a heel end of the vane with the substance stream.
Figure 10:
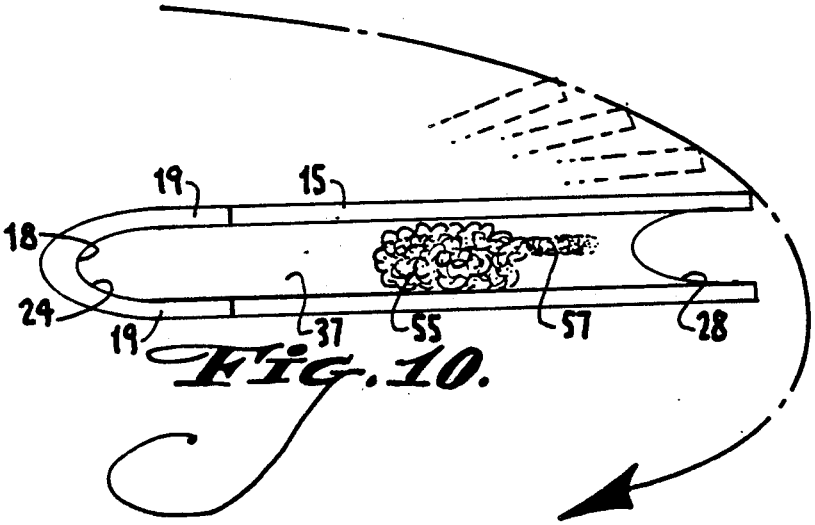
FIG. 10 is a perspective view of the vane intersecting the substance stream as shown in FIG. 5.
Figure 11:
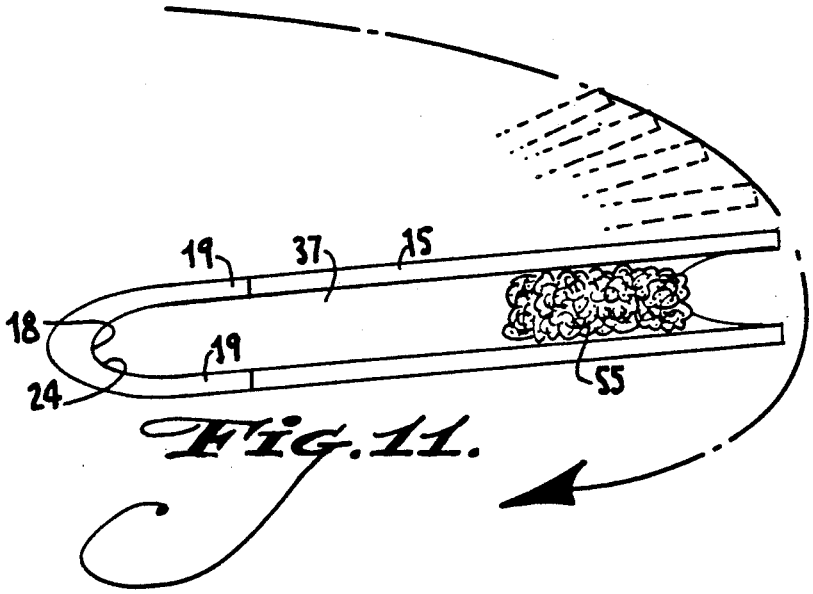
FIG. 11 is a perspective view of the vane intersecting the substance stream as shown in FIG. 6.

As shown in FIGS. 10 and 11, further rotation of the vane 15 accelerates the captured trailing end 64 of the stream segment 57 toward the leading end 75 of the stream segment and towards the toe end 28 of the vane. As the captured trailing portion moves outwardly on the vane and the leading portions are captured, a payload 55 is accumulated along the hollow front face 37 of the vane. The payload 55 increases in volume as the vane progressively intersects a greater portion of the stream segment 57. A V-shaped vane is preferred in order that legs 19 of the vane are long enough to completely capture the substance payload 55 while concentrating the substance as it accumulates in the vane and nears the toe end 28. Finally, the substance payload 55 is discharged from the toe end 28, in a direction which is the resultant of the tangential and radial components of the payload, whereby the substance payload 55 diffuses in a fan tail shaped spray pattern within a particular angle of rotation as more particularly illustrated in FIG. 3. The particular angle of discharge is the tangent of the spiral path of the payload, which by action of the invention has been accelerated and concentrated as compared to the substance stream emitted by the injector.

The distance from the rotation axis 12 to the heel end 24 affects the angle of diffusion of the discharged substance. The greater the distance, the lesser the angle of diffusion. Diffusion perpendicular to the plane of rotation is limited because the substance payload 55 is ejected substantially from the vertex of the V defined by the leading surface of the vane, and there are no forces acting on the substance charge in any direction other than in the plane of the centerline 40.

The front face 37 of the vanes must be wide enough to capture the substance stream 52, but it is preferable to minimize the width of the front face 37 in order to concentrate the payload of discharged substance spray. The width of the front face 37 ca be minimized by using a narrow stream width as emitted by the injector. In order to minimize the width of the substance stream 52, the outlet port 30 of the injector 45 has a flange or shoulder 49, as shown in FIG. 8, which creates a "vena contracta" 66 in the substance stream 52 in a length of the substance stream 52 which is intersected by the heel end 24 of the vane 15. The vena contracta 66 extends over a length designated as "L" in FIG. 8.

Figure 14:
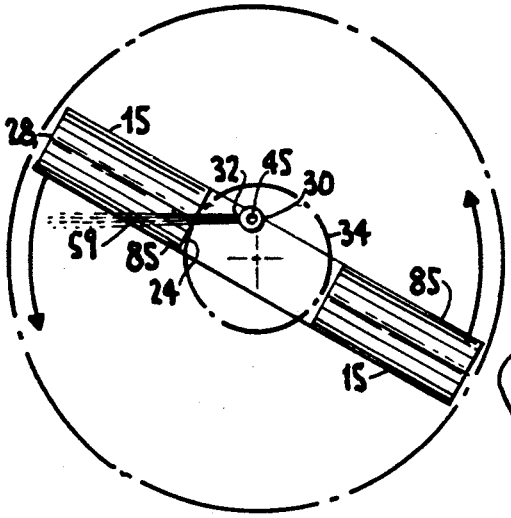
FIG. 14 is a plan view of the centrifugal spray apparatus having an injector with an opposite port for rotation in an opposite direction.

The centrifugal spray apparatus according to the invention may also rotate in the reverse direction, as shown in FIG. 14. In this case, the reverse vane 85 defines a hollow back face 87 disposed in an opposite direction from the front face 37. Whereas the injector stream must be intersected from the trailing end to the leading end the injector 45 can be re-oriented or provided with a second outlet port 32 disposed on an opposite side from the outlet port 30, for emitting a second stream 59 in a direction opposite to that of the stream 52. The second stream 59 can only be emitted when the vane is rotating in the reverse direction in order that the back face 87 correctly intersects the second stream 59 at an angle, i.e., progressively from the heel end 24 to the toe end 28 and from the trailing end of the stream segment to the leading end.

Figure 15:
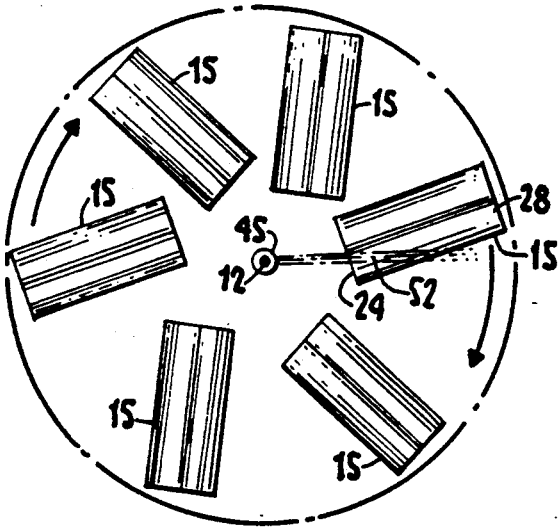
FIG. 15 is a plan view of an alternative embodiment having a radially directed injector stream and non-radial impeller vanes.

It is also possible to achieve spray operation according to the invention by orienting the injector stream radially and to incline the vanes of the impeller such that the vanes separate segments of the stream and accelerate them in the same manner as discussed herein above. Such an embodiment is shown in FIG. 15, using the same reference numbers to refer to corresponding elements. In this embodiment, although the stream 52 is radial relative to the axis of rotation 12, the vanes 15 are not radial but instead are inclined such that the radially innermost heel end 24 of the vane is located at an angle that leads the angle of the outermost toe end 28 in the direction of rotation of the impeller. As a result, the vane picks off a segment of the stream as the heel end passes the stream path, and successively picks up and accelerates the remainder of the stream segment as rotation continues.

The centrifugal spray apparatus according to the invention is useful in spray wash cleaning and surface finishing applications. The apparatus has the advantage of generating a spray having considerable impact energy as compared to the original injector stream at a distance of more than five feet from the source. The high impact energy of the spray mechanically loosens contaminants and carries them away. The apparatus can also be used to spray a slurry of particles in a liquid, e.g., for delivering abrasive particles such as Lexan shot in a spray. Even very fine particles such as aluminum oxide, glass beads and rouge can be carried in the spray and applied effectively at a distance of over five feet from the source. By comparison, in dry blasting using compressed air, friction with the surrounding air causes rapid loss of velocity. Effective working distance is usually less than one foot.

The invention having been disclosed, variations and additional embodiments within the scope and spirit of the invention will now become apparent to persons skilled in the art. The invention is not intended to be limited to the foregoing exemplary embodiments, but also to encompass reasonable variations and equivalents. Reference should be made to the appended claims rather than the foregoing specification to assess the scope of the invention in which exclusive rights are claimed.

I claim:

1. A centrifugal spray apparatus, comprising:

a rotatable shaft defining a rotation axis and means for rotating the shaft in a rotation direction around the axis;

a vane coupled to the shaft and oriented perpendicular to the rotation axis, the vane being elongated substantially radially from the rotation axis, the vane defining a heel end at a first radial distance from the rotation axis, a toe end at a second and radially greater distance from the rotation axis, and a front face in a direction of rotation, the vane moving in a plane upon rotation of the shaft; and, an injector having an outlet port and being operable for emitting a substance stream from the outlet port along a path substantially in the plane of the vane and in a direction causing the vane to intersect the substance stream progressively from the heel end to the toe end as the vane rotates and from a trailing end to a leading end of a stream segment intersected by the vane, the stream segment being guided along the front face of the vane and ejected along an arc which is substantially in the plane.

2. The apparatus according to claim 1, further comprising a plurality of said vanes coupled to the shaft.

3. The apparatus according to claim 1, wherein the vane is disposed substantially radially of the axis of rotation, and the path of the stream is non-radial.

4. The apparatus according to claim 3, wherein the outlet port of the injector is disposed at a distance from the rotation axis.

5. The apparatus according to claim 1, wherein the vane is disposed at an angle relative to a radial line extending from the axis of rotation, said angle being such as to intersect the heel end of the vane with the stream prior to the toe end intersecting the stream during rotation around the axis.

6. The apparatus according to claim 5, wherein the stream is oriented substantially along a radial line extending from the axis of rotation.

7. The apparatus according to claim 1, further comprising a spoke attached to the shaft, wherein the vane is attached to the spoke.

8. The apparatus according to claim 1, wherein the vane is coupled to a disk attached to the shaft.

9. The apparatus according to claim 1, wherein the vane has a substantially channel shaped cross-section.

10. The apparatus according to claim 9, wherein the channel has a cross-section which declines in width approaching a bottom of the channel.

11. The apparatus according to claim 10, wherein the channel is substantially V-shaped in cross section.

12. The apparatus according to claim 1, wherein the direction of rotation is reversible, and further comprising a reverse vane defining a leading face in a reverse direction.

13. The apparatus according to claim 4, wherein the direction of rotation is reversible, and further comprising a reverse vane disposed substantially radially of the axis of rotation defining a leading face in a reverse direction, and a means for varying the stream path for emitting the substance stream at an orientation for reverse rotation of the vane, said orientation for reverse rotation being non-radial.

14. The apparatus according to claim 12, wherein the substance injector has an other substance outlet suitable for emitting the substance stream during the reverse rotation of the vane.

15. The apparatus according to claim 12, wherein the vane and the reverse vane together have an X-shaped cross-section.

16. The apparatus according to claim 1, wherein the outlet port is disposed at a radial distance from the rotation axis.

17. The apparatus according to claim 4, wherein said outlet port is disposed at a radial distance from the axis within a circumference defined by the heel end as the vane rotates.

18. The apparatus according to claim 1, wherein the front face of the vane defines a hollow leading face in the rotation direction.

19. The apparatus according to claim 1, further comprising means for delivering to the injector outlet port a slurry of liquid and particles.

* * * * *